US006976557B2

(12) United States Patent
Becker

(10) Patent No.: US 6,976,557 B2
(45) Date of Patent: Dec. 20, 2005

(54) TOEBOARD SYSTEM FOR SCAFFOLDING

(75) Inventor: Allan James Becker, Concord (CA)

(73) Assignee: Aluma Enterprises Inc., Toronto (CA)

( * ) Notice: Subject to any disclaimer, the term of this patent is extended or adjusted under 35 U.S.C. 154(b) by 0 days.

(21) Appl. No.: 10/787,177

(22) Filed: Feb. 27, 2004

(65) Prior Publication Data

US 2005/0189173 A1 Sep. 1, 2005

(51) Int. Cl.[7] ..... A47L 3/02; E04G 1/16
(52) U.S. Cl. ..... 182/113
(58) Field of Search ..... 182/113, 106, 186.6, 182/186.7, 186.8, 179.1; 52/637, 638, 656.9; 248/235, 218.4, 219.1; 211/192, 191, 187; 108/108, 146; 403/49, 249, 245

(56) References Cited

U.S. PATENT DOCUMENTS

| | | | | |
|---|---|---|---|---|
| 595,064 | A * | 12/1897 | Herbst | 248/235 |
| 3,044,633 | A * | 7/1962 | Baker, Jr. | 211/191 |
| 3,523,612 | A * | 8/1970 | Hall | 211/191 |
| 3,606,028 | A * | 9/1971 | Klein | 211/191 |
| 4,219,175 | A | 8/1980 | Harig | |
| 5,078,532 | A * | 1/1992 | Williams | 403/246 |
| 5,205,524 | A * | 4/1993 | Cohen | 248/235 |
| 5,894,909 | A * | 4/1999 | Cornish | 182/186.8 |
| 5,896,721 | A * | 4/1999 | Sugiyama | 403/246 |
| 6,223,916 | B1 * | 5/2001 | Enos | 211/187 |
| 6,405,830 | B1 | 6/2002 | Hayman | |

* cited by examiner

*Primary Examiner*—Hugh B. Thompson, II
(74) *Attorney, Agent, or Firm*—Peter S. Gilster; Greensfelder, Hemker & Gale, P.C.

(57) ABSTRACT

A toeboard for a raised working platform advantageously cooperates with known construction systems to simplify securement and allow efficient setup. Each toeboard has connectors at either end of an elongate body member. Each connector has two fingers extending in a manner to intersect with a longitudinal axis of the elongate member. The connectors at opposite ends of the elongate body have an opposite orientation of said fingers where the fingers of one connector are 180 degrees out of alignment with the fingers of the other connector. This arrangement allows toeboards to connect easily in an end to end manner as well as in a perpendicular manner.

10 Claims, 5 Drawing Sheets

2
4
6
8
9
10
11
11a
11b
12
15
20
22
36
54
56

TOEBOARD SYSTEM FOR SCAFFOLDING

FIELD OF THE INVENTION

The present invention relates to scaffolding systems and in particular, to toeboard systems used to provide perimeter protection about a raised working surface.

BACKGROUND OF THE INVENTION

One of the main purposes of scaffolding is to provide a safe raised working surface used during the construction, repair or maintenance of a structure. Once the raised platform reaches a certain height, it is recommended or required that the working surface have a toeboard or restraint system to reduce the possibility of tools or material on the work platform accidentally being forced off the platform. As can be appreciated, many tools and/or materials can present a serious hazard if they fall from a platform and strike a person on the ground or on any lower work surface.

Many toeboard systems are merely of a wooden two by six fabricated construction while other toeboard systems are specifically designed to engage and be received in slots of upright members of the scaffolding system. Such integrated systems have not been readily accepted, probably due to the difficulty in using the system and the substantial increase in cost in manufacture of the uprights.

The present invention provides a toeboard system which is easy to use and takes advantage of the existing features of the common scaffolding systems for effective securement of the toeboard to the scaffolding system.

SUMMARY OF THE INVENTION

A toeboard for a raised working platform according to the present invention comprises an elongate member with connectors at opposite ends thereof with these connectors extending in line with and beyond the elongate body member. Each connector has two adjacent fingers at the free end thereof and the fingers extend in a manner to intersect with a longitudinal axis of the elongate member. The connectors at opposite ends of the elongate member have an opposite orientation with the fingers one connector orientated in a first direction and the fingers of the opposite connector orientated in a direction 180 degrees to the first direction.

According to an aspect of the invention, the outermost finger of each connector is offset relative to the adjacent finger of the connector such that the outermost finger is located to one side of the other finger.

According to a further aspect of the invention the elongate body is made of a metal and is generally L-shaped in cross section. This L-shape is defined by an upright portion and a foot portion.

In yet a further aspect of the invention, the connector is a metal plate secured to the upright portion on the side thereof above the foot portion.

In yet a further aspect of the invention, each connector terminates within a height dimension of the upright portion.

In yet a further aspect of the invention, the outermost finger is shorter than the inner finger.

In yet a further aspect of the invention, the elongate body has a series of securing holes spaced in the length thereof and these securing holes are used for engaging the toeboard during lifting thereof.

The present invention is also directed to a toeboard system used to provide perimeter protection about a working platform. The toeboard system comprises a series of connected toeboards where each toeboard comprises an elongate body member with connectors at opposite ends thereof. Each connector extends in line with and beyond the elongate body member with two adjacent fingers at the free end thereof. These fingers extend in a manner to intersect with the longitudinal axis of the respective elongate member. The connectors at opposite ends of each elongate body have an opposite orientation with the fingers of one connector orientated in a first direction and the fingers at the opposite connector orientated in the opposite direction. Each toeboard is connected to adjacent toeboards due to engagement of the connectors of adjacent toeboards.

In yet a further aspect of the invention, the toeboards of the system are connected one to the other such that cooperating connectors of the toeboard are interengaged and the interengaged connectors are positioned in a gap between a wedge member and upright support member of the scaffolding system.

In yet a further aspect of the invention, the toeboard system has the toeboards connecting in an end to end manner using the outermost fingers of the connector and the innermost fingers are used for connection of toe boards at an intercept angle one to the other.

BRIEF DESCRIPTION OF THE DRAWINGS

Preferred embodiments of the invention are shown in the drawings, wherein.

DETAILED DESCRIPTION OF THE PREFERRED EMBODIMENTS

Figures 1, 5, 6, 7, 8:
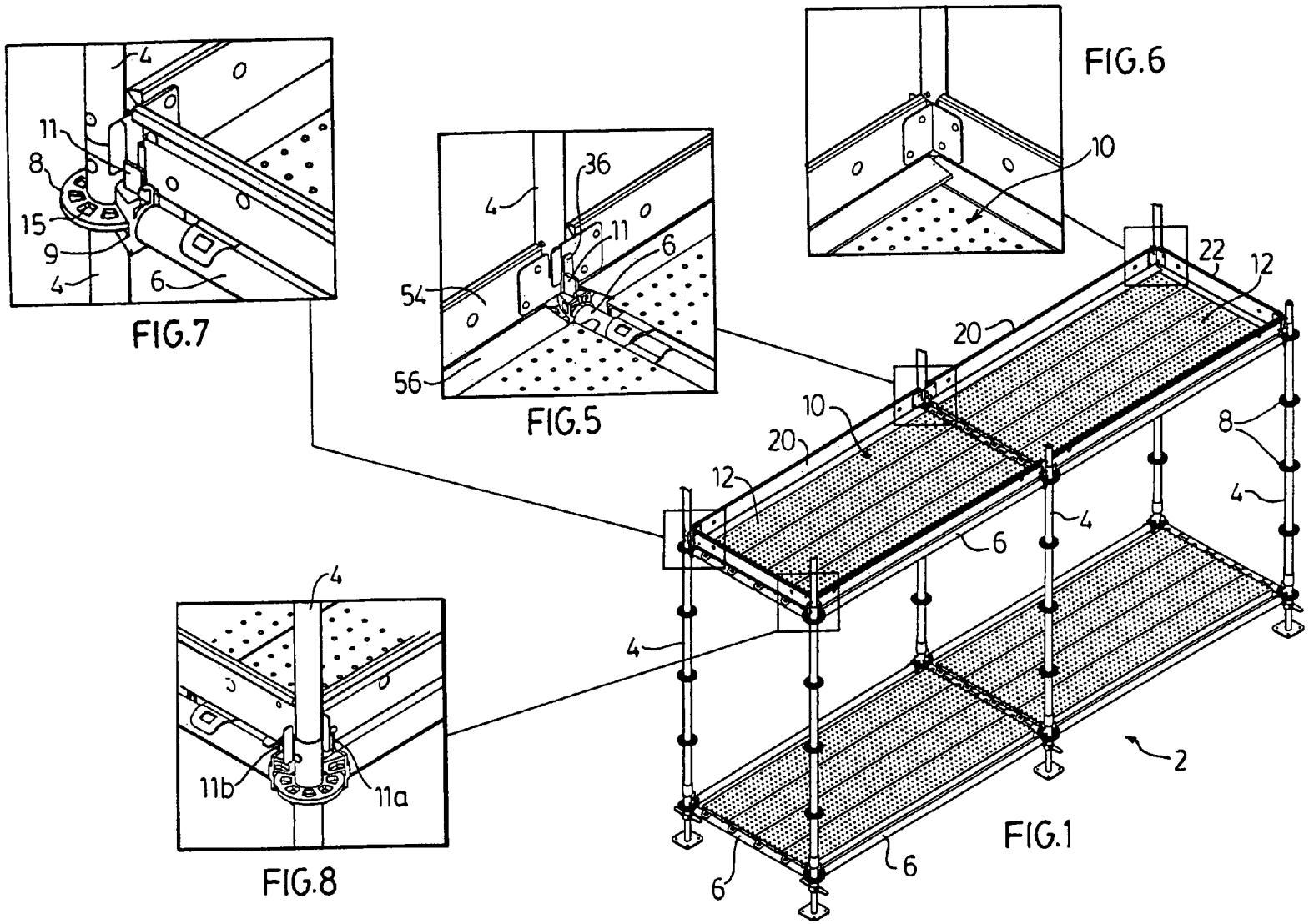
FIG. 1 is a perspective view of the scaffolding system with two defined working surfaces.
FIG. 5 is a partial perspective view showing connection of two toeboards at a scaffold support member where the toeboards are aligned one with the other.
FIG. 6 shows the connection of two toeboards at a right angle corner.
FIG. 7 is a partial perspective view showing the right angled toeboards and the upright support standard.
FIG. 8 is a view of a corner connection similar to FIG. 7.

Scaffolding systems such as the system 2 shown in FIG. 1, are used for the construction, repair and maintenance of buildings, bridges or other structures which are accessed by means of a raised work surface 10.

The specific scaffolding system 2 shown in the Figures, is formed by connecting a series of standards 4 to form the upright members of the scaffolding system and these standards are connected one to another by a series of horizontal ledgers 6. Diagonal bracing can also be provided. The raised work surface 10 is defined by the manufactured planks 12 which extend to and are supported by the ledgers 6. The standards 4 include a series of rosettes 8 which are at fixed positions on the standards 4 for connecting with the ledgers 6. As shown in FIG. 7, the ledger 6 has a connector 9 which is positioned either side of the rosette 8 and a wedge connector 11 passes through one of the series of ports 15 in the rosette to secure the ledger 6 to the standard 4. Each ledger is connected to a rosette in a similar manner. The wedge 11 is spaced slightly outwardly of the standard 4 and the toeboards will advantageously make use of the gap between the wedge 11 and the standard 4 for securing of the toeboard about the perimeter of the work surface 10.

Figure 2:
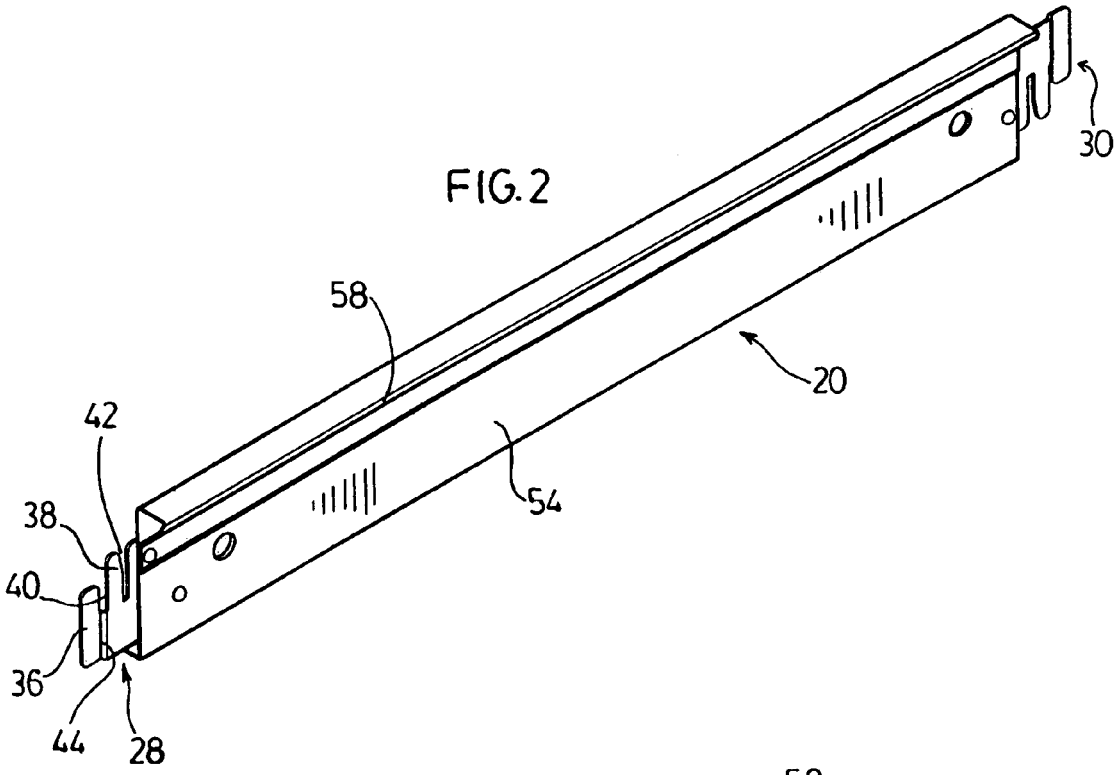
FIG. 2 is a perspective view of a toeboard used as part of the toeboard system.
Figure 3:
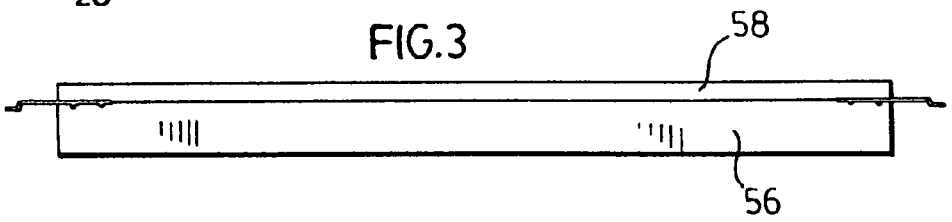
FIG. 3 is a top view of a toeboard.
Figure 4:
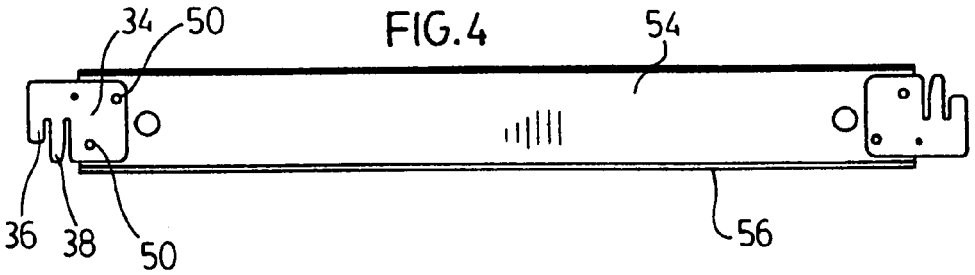
FIG. 4 is a side view of the toeboard.

Details of the toeboard are shown in FIG. 2. The toeboard 20 has a connector 28 at one end thereof and an oppositely orientated connector 30 at the opposite end of the toeboard. The elongate body of the toeboard is defined by the upright portion 54 in combination with the foot portion 56 and the reinforcing channel 58. The elongate body has a generally L-shaped cross section and is preferably made of metal. Each of the connectors 28 and 30 are secured to the upright portion 54 using rivets or other fasteners 50.

The connectors 28 and 30 are the same connector but have opposite orientations. Each connector has a connecting plate 34 used to secure the connector to the upright portion 54 and an outer finger 36 and an inner finger 38 positioned beyond the upright portion 54. The outer finger 36 is slightly offset from the plate by means of the bend 44 as shown in FIG. 2. The outer finger 36 and the inner finger 38 have a slot 40 therebetween which is used to secur two toeboards in an end to end manner as shown in FIG. 1. Inner finger 38 cooperates with the connecting plate 34 to define a further connecting slot 42. This slot is used for connecting toeboards in a perpendicular manner or in an intersecting manner.

As shown in FIG. 1, toeboard 20 is of a longer length than the toeboard 22. The scaffolding system 2 has one dimension for positioning standards 4 and in a direction perpendicular the first direction, the standards are positioned at a different spacing. Scaffolding systems of the type shown in FIG. 1 have standard modular dimensions. Two different spacings are used and two different sized toeboards are used. With the toeboard as shown in FIG. 2, the only difference between the long toeboards and the short toeboards is the length of the elongate body portion. The connectors will be the same. The toeboards will be of a length such that the space between the two securing slots 40 of a toeboard are such that they will align with the center of the upright standards. Typically, the modular spacing in length and width are multiples. For example, the width could be one third or one half of the length of the module.

As shown in FIG. 5, the outer slots 40 are used to connect the two toeboards such that these toeboards connect generally on the center of the standard 4. The connecting plates due to the offset and due to the opposite orientation of the connecting plates interconnect and form an overlapping non pivotting finger type connection. In addition the plates are trapped between the standard 4 and the wedge 11 of the ledger 6. With this arrangement, the toeboards are connected one to the other and the elongate body portions of the connected toeboards are positioned either side of the standard 4. Each foot of the toeboard overlaps with the working surface 10 and is partially supported on this surface. Any gap between the work plank 12 and the ledger which would be parallel to this plank, is covered by means of the foot portion 56.

FIG. 6 shows the connection of the toeboards at an end of the work surface 10. As can be appreciated from a review of FIG. 6, the connection point of the toeboard is at an inner edge of the standard 4 and is not on a centerline as would be the case with respect to FIG. 5. For this inside connection, the inner fingers 38 are used and the connecting slot 42. With this arrangement, the outer finger 36 of each of the connecting brackets extends across the face of the standard 4 and is trapped between a wedge 11 and the standard 4 as shown in FIG. 7.

FIG. 8 also shows how on one side of the standard 4 wedge 11*a* traps the connecting bracket between the wedge and the standard 4 and the other connecting plate is trapped between wedge 11*b* and the standard 4. Thus, the system for mechanically securing the ledgers 6 to the rosettes is also used to retain the connecting plates of the toeboards adjacent the standard.

Although the system has been described with respect to the two securing slots with the outerslots used for end to end connection and the inner slots used for an angled connection, there may be circumstances where the spacing between the standard is slightly off or there may be slight damage to one of the toeboards or combination thereof such that the connection is made by means of the other slot. In all cases, the overall length of the toeboards and connector for their respective insertion between spacing of the standards is such that the toeboards are of a slightly greater length to effect overlapping with these standards.

Figure 9:
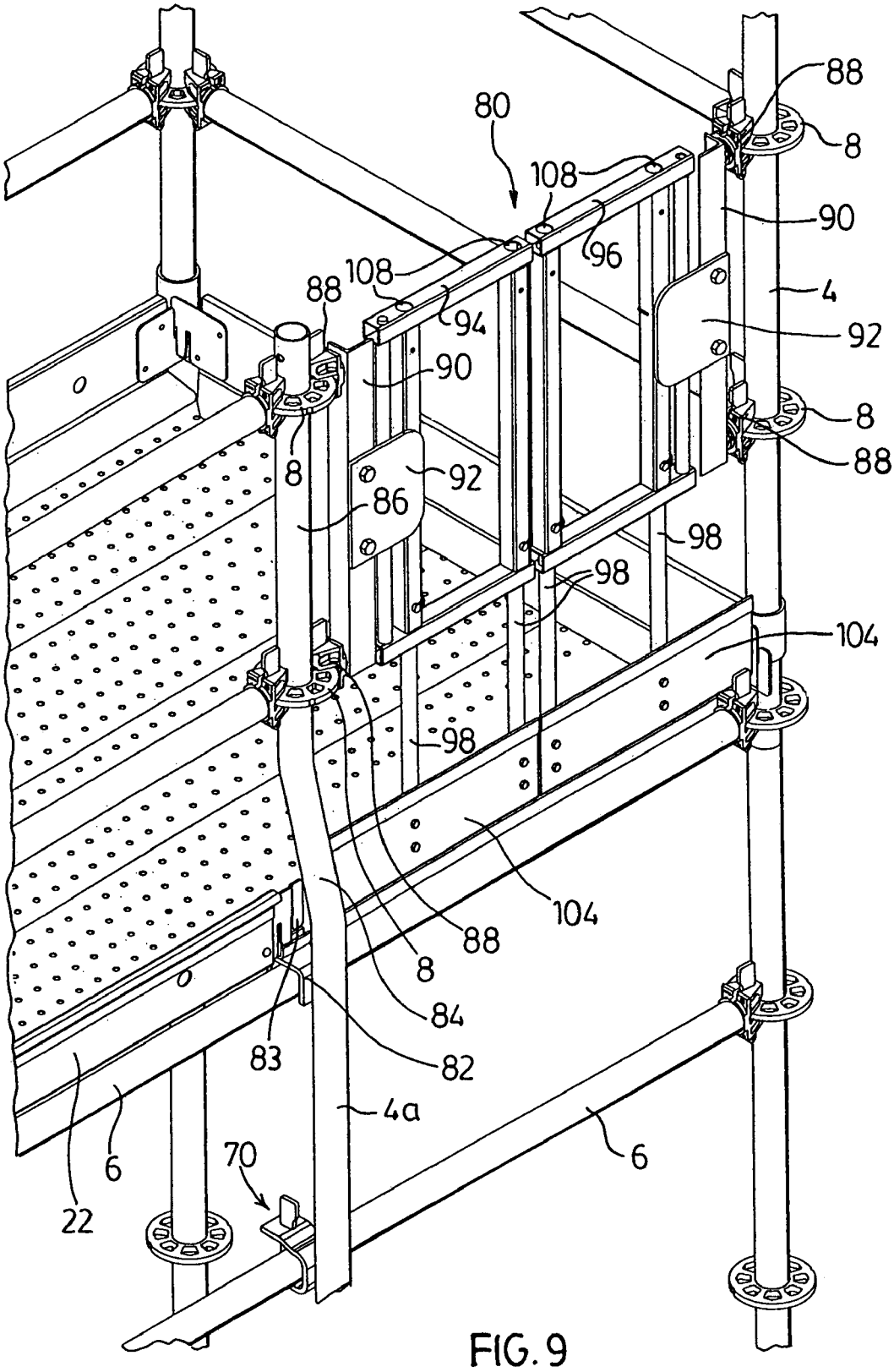
FIG. 9 is a partial perspective view of the toeboard system with an additional safety gate as part of the scaffolding system.
Figure 10:
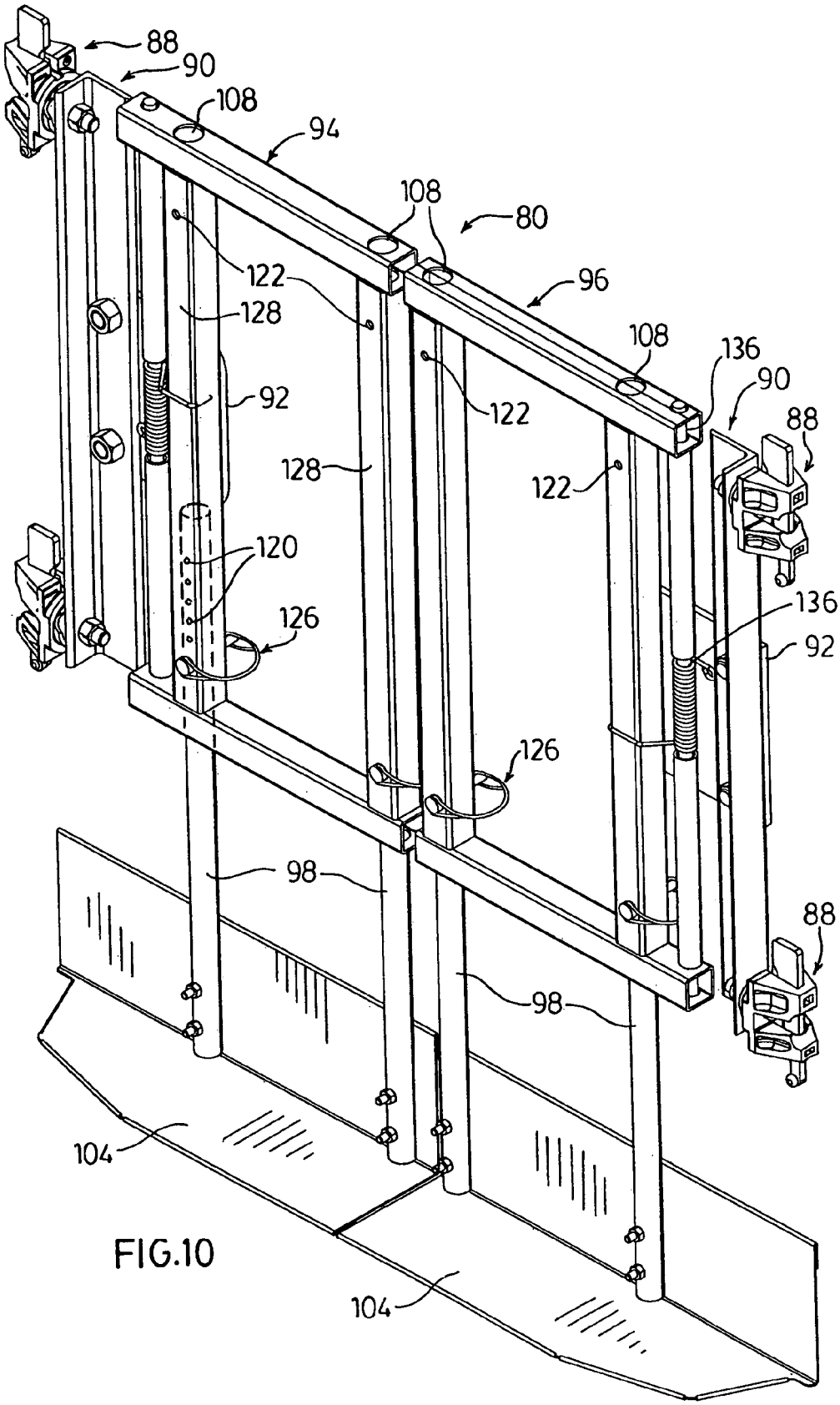
FIG. 10 is a perspective view of a safety gate and a connected swinging toeboard.
Figure 11:
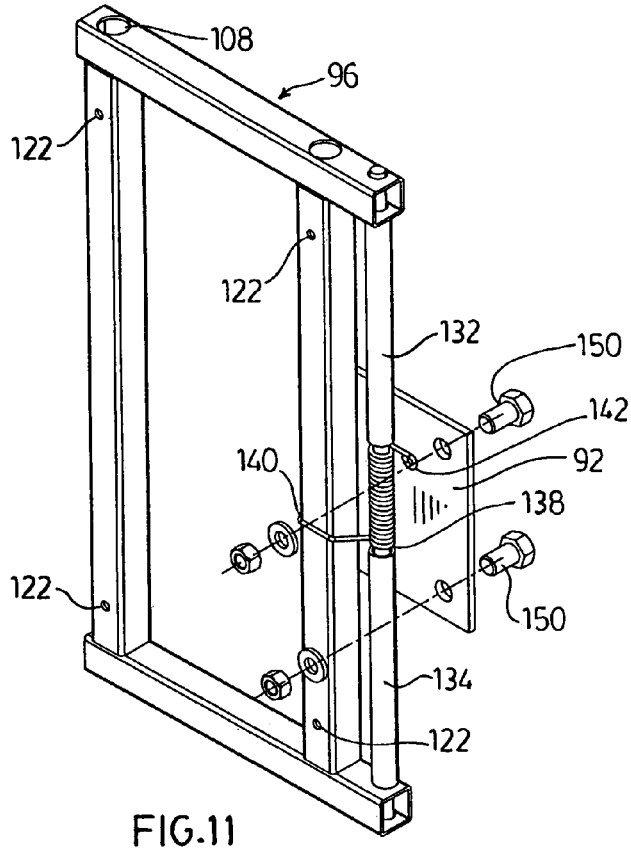
FIG. 11 is a perspective view of a swinging portion of the safety gates.

FIGS. 9, 10 and 11 show a specialized standard 4*a* and a safety gate 80. The standard 4*a* includes a lower securing connector 70 for fastening of the standard to the ledger 6. As can be appreciated, the standard 4A is to the outside of the connected ledger 6 and the ledger 6 directly thereabove. The standard 4*a* includes a saddle type bracket 82 which sits on the upper ledger 6. Immediately above the saddle bracket 82, the special ledger 4*a* has a bend 84 which merges with a further upright portion 86. The bend 84 brings upright portion 86 in line with the other standards. The safety bracket 80 includes standard wedge connectors 88 for securing of the safety gate to the rosettes 8.

The opposite side of the safety gate 80 is connected to the corner standard 4 using the rosettes 8 thereof and connectors 88 of the safety gate. The toeboard 22 is connected in a slot 83 of the saddle bracket 82. This slot 83 will either take the bottom edge of the connector or the innermost finger of the connector. The safety gate 80 has two L-shaped brackets 90 extending between the connectors 88 with each bracket 90 having a fixed stopped plate 92 secured thereto. The safety gate is defined by two swinging portions 94 and 96. Each of these swinging portions swing inwardly and cannot swing outwardly as they are stopped by the plates 92. The gates have a spring loaded pivot arrangement with the brackets 90 such that they are biased to the closed position as shown. The swing gate is also reversible by rotating the gate 180 degrees to allow opening in the opposite direction. This ability for opposite orientation is required as the work platform could be to the opposite side.

Extending downwardly from each of the swinging portions 94 and 96 are two tubular members 98 which support a swinging toeboard 104. The height of the swinging toeboards 104 is determined by the extent that members 98 extend downwardly from the respective swinging portions 94 and 96. Each of the downwardly extending members 98 have a series of holes 120 cooperating with ports 122 in tube slots 108 of each swinging portion 94 and 96 such that these members can be secured close to the working surface 10 but slightly thereabove to allow inward swinging movement. With the gate in the closed position, the toeboards 104 form a perimeter block below the safety gate.

FIG. 10 shows a pin and latch member 126 which passes through ports 122 in square uprights 128 of each swinging portion and through an appropriate hole 120 in tubular members 98. The lower portion of the square tubes 128 are shown in FIG. 10 as being transparent, such that the adjustable securement of tube members 98 is more easily understood. In this way, the toeboard 104 is easily adjusted in height and is free to swing over the working surface 10. Ports 122 are also provided on the upper ends of square uprights 128 as each swing portion is reversible in a vertical plane. The connectors 88 can also be rotated 180 degrees such that the captured latch wedge 130 will engage a rosette by being driven downwardly.

The hinge of each swinging portion 94 or 96 is defined by the tube member 132 and 134 fixed to the stop plate 92 and an axle rod 136 captured at either end by the swinging portion. This axle rod 136 passes through the tube members 132 and 134 and forms a hinge therewith. A helical spring 138 is sleeved on the axle rod 136 in the gap between the tube members 132 and 134. End 140 of the helical spring is secured to the swinging portion 96 and spring end 142 is secured to the stop plate 92.

Figure 12A:
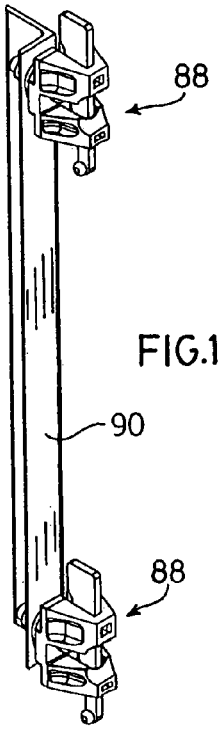
FIG. 12*a* is a perspective view of an "L" shaped securing bracket.
Figure 12B:
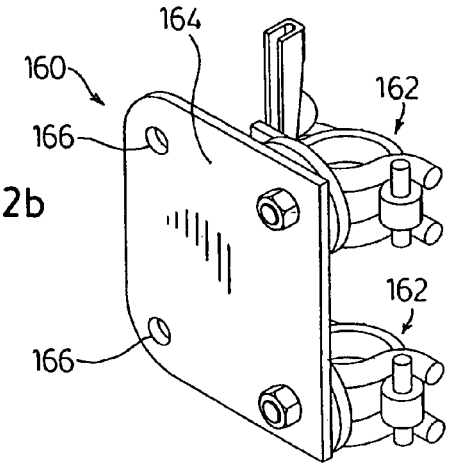
FIG. 12*b* is a perspective view of an alternate securing bracket.

FIGS. 12*a* and 12*b* show two arrangements for fastening of the swinging portions 94 or 96 to an upright of a scaffolding system. FIG. 12*a* shows the 'L' shaped bracket 90 securable to the stop plate 92 of FIG. 11 using the bolt and net fasteners 150. This bracket includes the rotatable captured wedge connectors 88. FIG. 12*b* shows a clamp connector 160 having two clamp members 162 of a traditional design mechanically secured to the plate extension 164. Plate extension 164 has two ports 166 for receiving bolt and nut fasteners 150. Each arrangement of FIGS. 12*a* and 12*b* secure to the stop plate 92 shown in FIG. 11.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A toeboard for a raised working platform, said toeboard comprising an elongate body member with connectors at opposite ends thereof, each connector extending inline with and beyond said elongate body member with two adjacent fingers at a free end of the connector and extending in a manner to intersect with a longitudinal axis of said elongate body member with said fingers being spaced along the longitudinal axis to define an outer finger and an inner finger, said connectors at opposite ends of said elongate body member having an opposite orientation with the fingers of one connector orientated in a first direction and the fingers of the opposite connector orientated 180 degrees to said first direction.

2. A toeboard as claimed in claim 1 wherein said outer finger of each connector is offset relative to the inner finger to locate the outer finger to one side of said other finger.

3. A toeboard for a raised working platform, said toeboard comprising an elongate body member with connectors at opposite ends thereof, each connector extending inline with and beyond said elongate body member with two adjacent fingers at a free end thereof and extending in a manner to intersect with a longitudinal axis of said elongate member, said connectors at opposite ends of said elongate body having an opposite orientation with the fingers of one connector orientated in a first direction and the fingers of the opposite connector orientated 180 degrees to said first direction wherein an outermost finger of said two fingers is offset relative to the other finger to locate it to one side of said other finger, wherein said elongate body member is made of a metal and is generally "L" shaped in cross section defined by an upright portion and a foot portion.

4. A toeboard as claimed in claim 3 wherein each connector is a metal plate secured to said upright portion on the side thereof above said foot portion.

5. A toeboard as claimed in claim 3 wherein the fingers of each connector terminate within a height dimension of said upright portion.

6. A toeboard as claimed in claim 5 wherein the outermost finger is shorter than the other finger.

7. A toeboard as claimed in claim 6 wherein said elongate body member has a series of securing holes spaced in the length of said elongate body for securing of said toeboard during lifting thereof.

8. A scaffolding system having at least one raised working platform with a toeboard system about a perimeter of said working platform, said toeboard system comprising a series of connected toeboards;

each toeboard comprising an elongate body member with connectors at opposite ends thereof, each connector extending inline with and beyond said elongate body member with two adjacent fingers at a free end thereof and extending in a manner to intersect with a longitudinal axis of said elongate body member, said connectors at opposite ends of said elongate body member having an opposite orientation with the fingers of one connector orientated in a first direction 180 degrees to said first direction, each toeboard being connected to adjacent toeboards due to engagement of connectors of adjacent toeboards.

9. A scaffolding system as claimed in claim 8 wherein said toeboards connect one to another such that the cooperating connectors of the toeboard are interengaged and the interengaged connectors are positioned in a gap between a wedge member and an upright support member of said scaffolding system.

10. A scaffolding system as claimed in claim 9 wherein some of said toeboards are connected in an end to end manner using outermost fingers of the connectors of the respective toeboards, and some of said toeboards are connected at an angle using inner fingers of the connectors of the respective toeboards.

* * * * *

UNITED STATES PATENT AND TRADEMARK OFFICE

CERTIFICATE OF CORRECTION

PATENT NO. : 6,976,557 B2
APPLICATION NO. : 10/787177
DATED : December 20, 2005
INVENTOR(S) : Allan James Becker It is certified that error appears in the above-identified patent and that said Letters Patent is hereby corrected as shown below:

TITLE PG. ITEM (73) ASSIGNEE
The name of Assignee is incorrect and should be:
Brand Services, Inc. (Chesterfield, MO)

Signed and Sealed this

Nineteenth Day of February, 2008

JON W. DUDAS
*Director of the United States Patent and Trademark Office*